United States Patent [19]

Mitsui

[11] 4,417,257

[45] Nov. 22, 1983

[54] PRINTING HEAD FOR THERMAL PRINTER

[75] Inventor: Yoshihiro Mitsui, Shiojiri, Japan

[73] Assignees: Epson Corporation, Nagano; Kabushiki Kaisha Suwa Seikosha, Tokyo, both of Japan

[21] Appl. No.: 332,125

[22] Filed: Dec. 18, 1981

[30] Foreign Application Priority Data

Dec. 22, 1980 [JP] Japan ..... 55-184380[U]
Dec. 24, 1980 [JP] Japan ..... 55-185806[U]

[51] Int. Cl.[3] ..... H05B 1/00
[52] U.S. Cl. ..... 346/76 PH; 219/216
[58] Field of Search ..... 400/120; 219/216 PH; 346/76 R, 76 PH, 135.1

[56] References Cited

U.S. PATENT DOCUMENTS 3,973,106 8/1976 Ura ..... 219/216 PH
4,074,109 2/1978 Baraff et al. ..... 346/76 PH X
4,130,752 12/1978 Conta et al. ..... 219/216 PH
4,173,273 11/1979 Hanakata ..... 400/120

FOREIGN PATENT DOCUMENTS 647531 2/1979 U.S.S.R. ..... 219/216 PH

OTHER PUBLICATIONS

I.B.M. Technical Disclosure Bulletin, vol. 21, No. 1, pp. 284–285, Jun. 1978.

*Primary Examiner*—Donald A. Griffin
*Attorney, Agent, or Firm*—Blum, Kaplan, Friedman, Silberman & Beran

[57] ABSTRACT

A printing head for use in a thermal printer is provided. The printing head includes a substrate and an elongated smooth glaze layer is formed on a portion of the substrate. A plurality of heating elements are disposed on the glaze layer in a vertical column. Electrodes on the substrate selectively activate the heating elements to form characters on a thermosensitive recording paper.

22 Claims, 14 Drawing Figures

FIG. 1
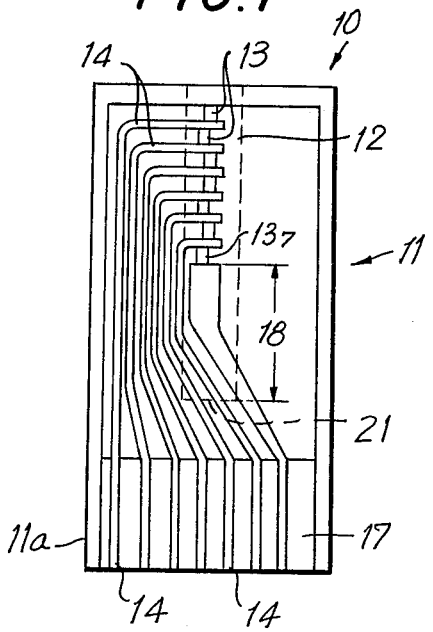
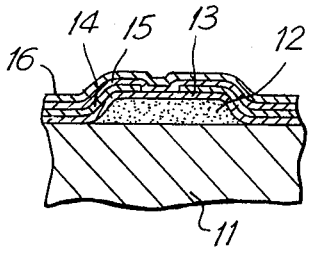
FIG. 2
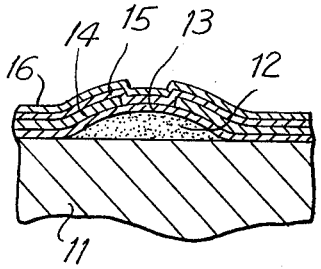
FIG. 3

FIG.6
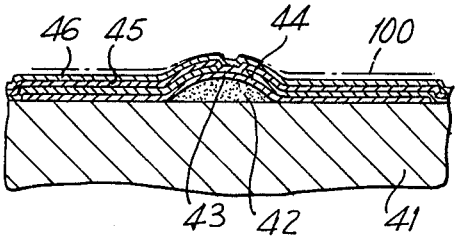
FIG.7
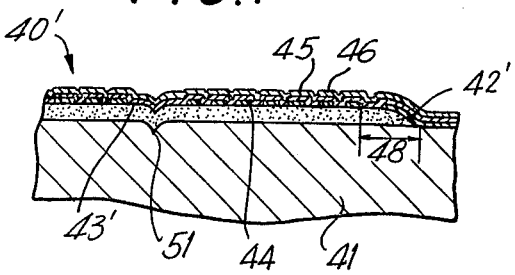
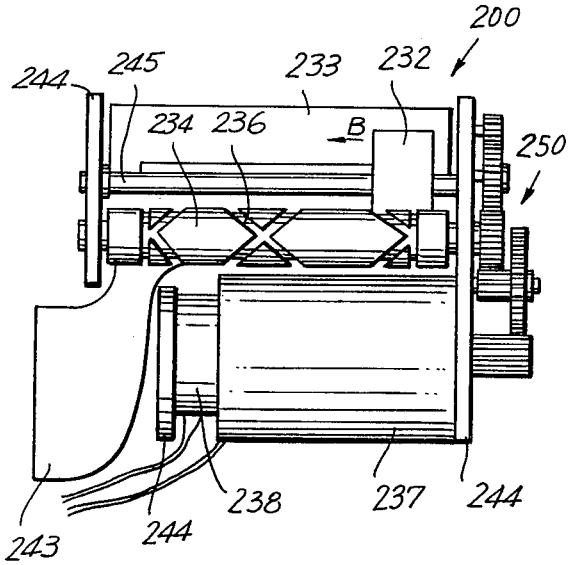
FIG.8
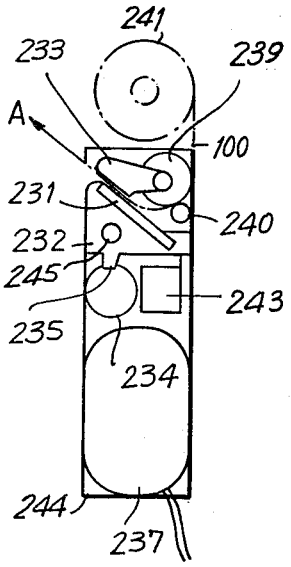
FIG.9

FIG. 10
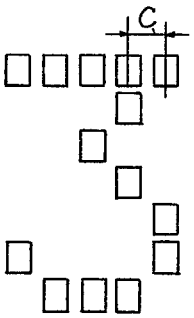
FIG. 11
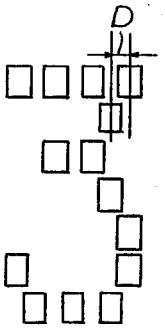
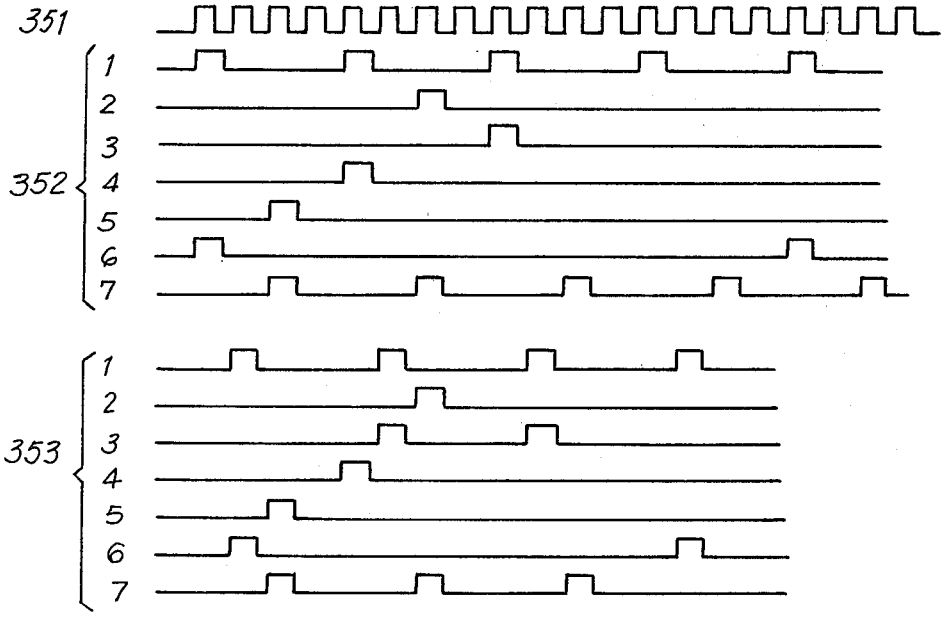
FIG. 12

PRINTING HEAD FOR THERMAL PRINTER

BACKGROUND OF THE INVENTION

This invention is directed to a thermal printer and, in particular, to an improved construction of a thermal printing head for use in thermal printers.

Thermal printers such as that described in U.S. Pat. No. 4,088,214 which is incorporated by reference herein as though fully set forth herein, are generally smaller in size and simplier in construction than conventional mechanical printer mechanisms which have, for example, print wheels including types which strike a recording medium. Thus, thermal printers are readily adaptable for use and can be incorporated as the output printer in small-sized pocket electronic calculators and the like. Thermal printers include a thermal printing head which selectively applies heat to a thermosensitive recording medium to print characters thereon. A particular construction and the operation of such a thermal printing head is described in U.S. Pat. No. 4,048,470 which is incorporated by reference herein as though fully set forth herein. See also U.S. Pat. No. 3,512,158. Conventional thermal printing heads do not provide a high printing quality since it has proven difficult to bring the thermosensitive recording paper into close contact with the heating elements on the printing head which form dots on the thermosensitive paper to form the characters thereon.

In order to be practically feasible, pocket electronic calculators require a small-sized thermal printer and cell (battery) utilized as a power supply. The cell can be, for example, a SUM-3 type or the smaller SUM-4 type manganese cell. The manganese cell is less costly than alkali-manganese and nickel-cadmium cells, but has an internal resistance of about 0.5Ω/cell which is relatively large as compared with the alkali-manganese cell that has an internal resistance of about 0.4Ω/cell and the nickel-cadmium cell that has an internal resistance of about 0.02Ω/cell.

Accordingly, the present invention provides a printing head for a thermal printer having improved printing quality which is readily adaptable for use in pocket electronic calculators and the like since it requires less power to operate. The improved printing head of the present invention is small-sized, yet provides a good printing quality which allows a thermal printer incorporating such an improved printing head to be small in size.

SUMMARY OF THE INVENTION

Generally speaking, in accordance with the present invention, an improved printing head for a thermal printer is provided. The thermal printer includes a mechanism for laterally translating the printing head across a thermosensitive recording medium. The improved printing head includes a substrate having a substantially smooth layer of glaze formed on a portion thereof. A plurality of heating elements divided into two groups are longitudinally arranged on the glaze layer. Electrodes disposed on the substrate are associated with the plurality of heating elements and selectively activate the heating elements to form dots on the thermosensitive medium as the printing head traverses laterally across the thermosensitive medium to define characters.

Accordingly, it is an object of the present invention to provide an improved printing head for a thermal printer.

Another object of the present invention is to provide a printing head for a thermal printer which provides an improved printing quality.

A further object of the present invention is to provide an improved printing head for a thermal printer which requires relatively low energy to operate.

Still another object of the present invention is to provide a thermal printer which is readily adaptable for use in pocket electronic calculators and the like due to the relatively low power consumption thereof and the small size of the printing head.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a plan view of a thermal printing head partially constructed in accordance with the prior art;

FIGS. 2 and 3 are alternative enlarged partial cross-sectional views of the printing head depicted in FIG. 1;

FIG. 6 is a cross-sectional view of the thermal printing head depicted in FIG. 5;

FIG. 7 is a partial longitudinal cross-sectional view of the thermal printing head depicted in FIG. 5 shown coupled to a second printing head;

FIG. 8 is a top plan view of a serial thermal printer incorporating the printing head of the present invention;

FIG. 9 is a sectional side elevational view of the serial thermal printer depicted in FIG. 8;

FIG. 10 is an illustration of a character printed by the thermal printing head of the present invention in a 5×7 dot matrix;

FIG. 11 is an illustration of a character printed with the thermal printing head of the present invention in a 9×7 dot matrix utilizing a half dot pitch;

FIG. 12 is a timing chart depicting the signals applied to print the characters depicted in FIGS. 10 and 11;

DESCRIPTION OF THE PREFERRED EMBODIMENTS

Figure 4:
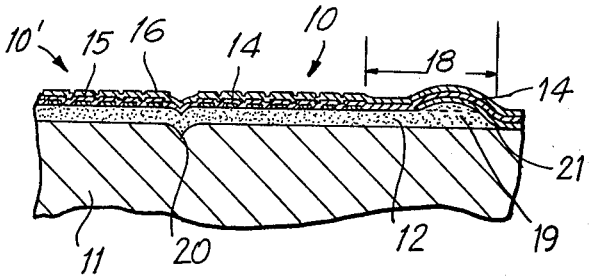
FIG. 4 is an enlarged partial longitudinal cross-sectional view of the printing head depicted in FIG. 1 shown coupled to a second printing head.

Reference is first made to FIGS. 1 through 4 to describe the construction of a printing head, generally indicated at 10, for use in a thermal printer and partially constructed in accordance with the prior art. Printing head 10 includes a substrate 11, formed from alumina. A layer of glaze 12 indicated by broken lines in FIG. 1 is printed and calcined on substrate 11. A plurality of heating elements 13 constructed from $Ta_2N$ are linearly longitudinally arranged on the layer of glaze 12. A plurality of electrodes 14 extend from end 11*a* of printing head 11 onto glaze layer 12 and are disposed with respect to heating elements 13 so as to permit selective activation of heating elements 13. An acid proof layer 15 and a wear-resistant layer 16 are also provided on substrate 11.

Glaze layer 12 serves as a thermally resistant layer for heating elements 13 to transmit heat effectively to a thermally sensitive medium such as thermosensitive paper. Glaze layer 12 also serves to elevate the heating elements 13 higher than other elements or parts on the substrate which are not involved in printing characters on the thermosensitive paper thus providing a better degree of contact with the thermosensitive paper.

As shown in FIG. 1, glaze layer 12 is shaped rectangularly such that it has a width larger than the lateral dimension of heating elements 13 which are linearly longitudinally arranged as a vertical column of seven dots. Glaze layer 12 has a longitudinal dimension or length larger than the length of the vertical column of heating elements 13 and a cross-section which may be trapezoidal as depicted in FIG. 2 or arched (segmental) as depicted in FIG. 3. Both of the configurations depicted in FIGS. 2 and 3 of glaze layer 12 act to raise heating elements 13 from the surface of the substrate in order to attempt to bring them into closer contact with the thermosensitive recording medium.

Referring to FIG. 4, the problems with the conventional thermal printing head will be described. In FIG. 4, alumina substrate 11 has a recess or indentation 20 which would be provided where a second printing head 10' is provided adjacent to printing head 10. When such a construction is used, glaze layer 12 is disposed over recess 20 and extends commonly on the two printing heads where the respective heating elements are adjacent each other. Glaze layer 12 has a lower end 21 which terminates at a position between the last (seventh) heating element $13_7$ and an electrode coupling section 17 which acts as a connector for a flexible printed circuit. End 21 of glaze layer 12 extends at a right angle to the sides thereof which sides extend parallel to the longitudinal vertical column of heating elements 13.

Glaze layer 12 terminates between the last (seventh) heating element $13_7$ and electrode section 17 to allow electrode section 17 to remain substantially flat for easy connection with an external flexible printed circuit. However, a bulge 19 (FIG. 4) is created adjacent to end 21 of glaze layer 12 due to the properties of the material forming the glaze layer including the contact angle, the surface tension, the viscosity, the temperature at which glaze layer 12 is calcined and the like. Bulge 19 is a phenomenon that should be avoided if possible because it does not allow close contact to occur between heating elements 13 and a thermosensitive paper. This results in the failure to transmit sufficient heat from the lower heating elements to the thermosensitive paper thereby resulting in a poor printing quality. Since heating elements 13 are depressed by the thickness (2–3$\mu$) of electrodes 14, heating elements 13 should not lose close contact with the thermosensitive paper which is caused by bulge 19 which is on the order of 10$\mu$ thick.

If the viscosity of glaze layer 12 were lowered in order to reduce bulge 19, glaze layer 12 itself would not form a sufficient rise (arch) which would have thickness between 20–60$\mu$ and hence would fail to retain the advantages of utilizing a raised glaze layer. Thus, there is a problem in maintaining a required amount of swelling below heating elements 13 while reducing bulge 19. Heretofore, bulge 19 has been taken for granted and printing quality has been prevented from getting worse by increasing the distance, indicated as 18, between the last (seventh) heating element $13_7$ and end 21 of glaze layer 12.

The construction of a conventional thermal printing head partially depicted in FIGS. 1 through 4 presents a limitation on the attempt to make thermal printing heads shorter and the thermal printer lower in profile. Consequently, the thermal printer cannot be fabricated less costly since the area of the printing head therein cannot be reduced due to the size limitation placed thereon by the bulge.

Figure 5:
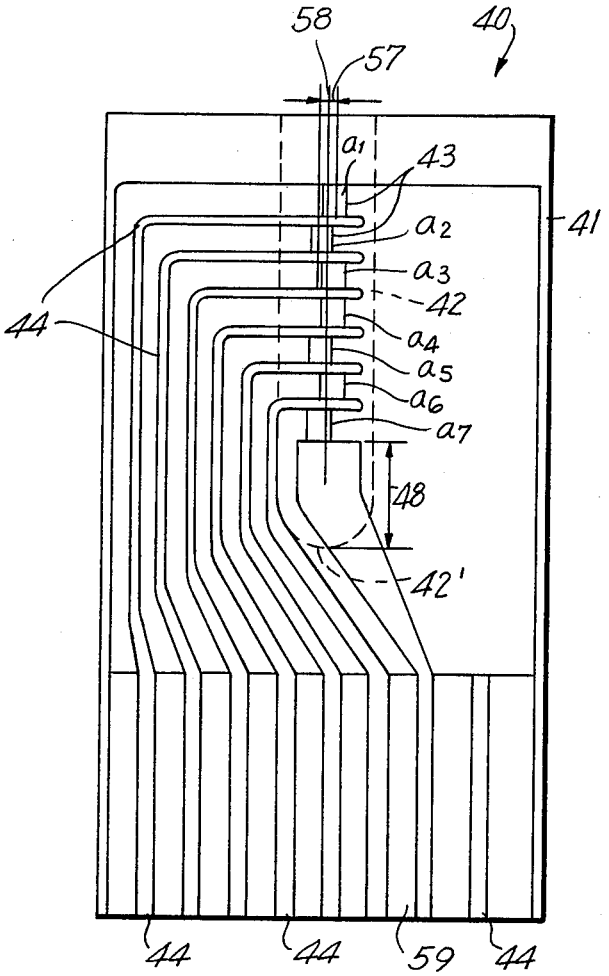
FIG. 5 is a plan view of a thermal printing head constructed in accordance with the present invention.

Reference is now made to FIGS. 5 through 7 in order to describe the construction of a thermal printing head, generally indicated at 40, constructed in accordance with the present invention. Printing head 40 includes a substrate 41 formed from alumina. A layer of glaze 42 indicated by broken lines is printed and calcined on a portion of substrate 41. A plurality of heating elements 43 are longitudinally arranged in staggered relation in a vertical column on glaze layer 42. As depicted in FIG. 5, seven heating elements 43 indicated by $a_1, a_2 \ldots, a_7$ are provided with the upper most heating element being designated as $a_1$ and the lower most or seventh heating element being designated as $a_7$. Heating elements 43 are made of $Ta_2N$. A plurality of electrodes 44 extend onto glaze layer 42 and are provided for selectively activating heating elements 43. An acid proof layer 45 and a wear-resistant layer 46 are also provided on top of heating elements 43 and electrodes 44.

The lower end 42' of glaze layer 42 is arcuately shaped so as to form an obtuse angle with the longitudinal extent (sides) of glaze layer 42. Unlike the flat (rectangular) end 21 of glaze layer 12 in conventional thermal printing heads as depicted in FIG. 1, the rounded end 42' of partial glaze layer 42 is not shaped to block a fluid flow, but is shaped to allow a fluid to flow freely thereby resulting in elimination of bulge 19 which is found in conventional printing heads as depicted in FIG. 4. With such an arrangement, the distance 48 between seventh heating element $a_7$ and end 42' of glaze layer 42 can be substantially shortened as depicted in FIG. 7.

As depicted in FIG. 5, heating elements 43 may be considered as divided into two groups, the first group including the first $a_1$, third $a_3$, fourth $a_4$ and sixth $a_6$ heating elements and the second group including the second $a_2$, fifth $a_5$ and seventh $a_7$ heating elements. A distance 57 between the longitudinal axes of the respective two groups of heating elements corresponds to one-half of a dot pitch of a character printed with a $5 \times 7$ dot matrix. The longitudinal center axis 58 of the two respective groups of heating elements is aligned with the longitudinal center axis of the alumina substrate 41 and also of partial glaze layer 42 which is centrally positioned with respect to the sides of substrate 41.

Partial glaze layer 42 has a segmental (arched) cross-section as depicted in FIG. 6 with the crest thereof positioned in alignment with the longitudinal center 58 of the two respective groups of heating elements 43.

Partial glaze 42 has a width larger than that of the respective two groups of heating elements 43 and has one end extending from first heating element $a_1$ upwardly to an end of alumina substrate 41 so as to be contiguous to the first heating element 43' on an adjacent printing head 40', as depicted in FIG. 7, should such an adjacent printing head be desired. A recess or indentation 51 is provided in substrate 41 to define a separation between the two adjacent printing heads.

The lower end 42' of glaze layer 42 is located between seventh heating element $a_7$ and an electrode coupling section 59 at the end of printing head 40. Electrode coupling section 59 is provided for connecting head 40 to an external flexible printed circuit. As aforenoted, end 42' of glaze layer 42 is arcuately shaped to allow the fluid forming the glaze layer to flow freely before it hardens. As depicted in FIG. 7, end 42' of glaze layer 42 gradually inclines downwardly so that glaze layer 42 smoothly blends into alumina substrate 41 without any bulges or protrusions.

Referring to FIG. 6, a thermosensitive paper 100 in a thermal printer can be brought into close contact with heating elements 43 as separated into the two groups depicted in FIG. 5. The smooth arched surface of glaze layer 42, without any bulges, allows the thermosensitive paper 100 to be brought into close contact with heating elements 43 so that a high printing quality of dots which form characters can obtained.

Referring now to FIGS. 8 and 9, the construction of a thermal printer, generally indicated at 200 incorporating a thermal print head 231 constructed in accordance with the present invention, will be described. Printing head 231 is carried by a carriage 232 which moves laterally across a thermosensitive paper 100 supplied from a roll of thermosensitive paper 241. Carriage 232 and hence printing head 231 carried thereon moves laterally across thermosensitive paper 100 so as to print a line of characters thereacross. Printer 200 also includes a platen 233 disposed in confronting relation to thermal printing head 231 and a feed cam cylinder 234 having a slot 236 formed in the periphery thereof which receives a projection 235 on carriage 232. A dc motor 237 rotates feed cam cylinder 234 which in turn causes carriage 232 to traverse across the thermosensitive paper 100.

A tachogenerator 238 is coaxially mounted with the drive shaft of motor 237. Tachogenerator 238 generates signals representative of dot positions. Printer 200 also includes a paper feed roller 239 and an auxiliary roller 240. The passage of thermosensitive paper 100 through printer 200 is indicated by arrow A. A flexible printed circuit 243 is connected to the electrode section of printing head 231 for transmitting signals provided by tachogenerator 238 thereto. Printer 200 also includes a frame 244 and a guide shaft 245 on which carriage 232 is slideably mounted.

In order to print characters along one line on thermosensitive paper 100, electrical power is supplied to dc motor 237 which in turn rotates feed cam cylinder 234 by means of a gear train generally indicated at 250. Carriage 232 will be caused to move in the direction of arrow B while printing head 231 is selectively energized through the flexible printed circuit 243 in response to dot signals supplied from tachogenerator 238.

After carriage 232 reaches the left side of thermosensitive paper 100, carriage 232 will begin to traverse thermosensitive paper 100 in the opposite direction due to the intersecting slots 236 provided on feed cam cylinder 234. On the returning stroke of carriage 232, paper feed roller 239 will be caused to rotate thereby feeding the paper against auxiliary roller 240. Thereafter, dc motor 237 will be deenergized.

The height of printer 200 is mainly based on the length of printing head 231. Utilizing the construction of the printing head according to the present invention, a head having a length of 8 mm allowed a printer having a height of 9 mm to be constructed.

FIG. 10 illustrates the numeral "3" as printed with a 5×7 dot matrix by the printing head of the present invention. The distance or pitch of one full dot is indicated in FIG. 10 as C. FIG. 7 illustrates the numeral "3" as printed with 9×7 dot matrix utilizing half dots. In FIG. 11, the distance or pitch of one half dot is indicated by D.

FIG. 12 is a timing chart depicting the signals and pulses supplied to energize the first through seventh heating elements depicted in FIG. 5 to print the numerals "3" depicted in FIGS. 10 and 11. Signals 351 are dot signals supplied by tachogenerator 238 depicted in FIG. 8. Signals 352 are the pulses applied to the first through seventh heating elements in the 5×7 dot matrix to print the numeral "3" depicted in FIG. 10. Pulses 353 depicted in FIG. 12 are applied to the first through seventh heating elements for the 9×7 dot matrix for printing the numeral "3" depicted in FIG. 11. The maximum number of heating elements that are simultaneously energized is two for both the 5×7 and 9×7 dot matrices. When printing the numeral "1", only four heating elements are energized at the same time.

The arrangement of the heating elements and construction of the printing head according to the present invention is advantageous in that the maximum number of simultaneously energizable heating elements is four even with the use of half dots, and the four heating elements (first, third, fourth and sixth) in the first group are energized at a higher cell voltage while the three heating elements forming the second group (second, fifth and seventh), are energized at a lower cell voltage, thereby reducing the difference between shades of printed characters and permitting the use of manganese cells. The heating elements, as divided into two groups as described above and staggered in the longitudinal direction of the printing head are disposed on both sides of the crest of the rounded upper surface of the partial glaze layer with the longitudinal center of the combined two groups of heating elements protruding on the crest of the glaze layer, thus allowing close contact between the heating elements and the thermosensitive paper. Therefore, with the present arrangement, a high printing quality is available with heating elements powered by a manganese cell.

Figure 13:
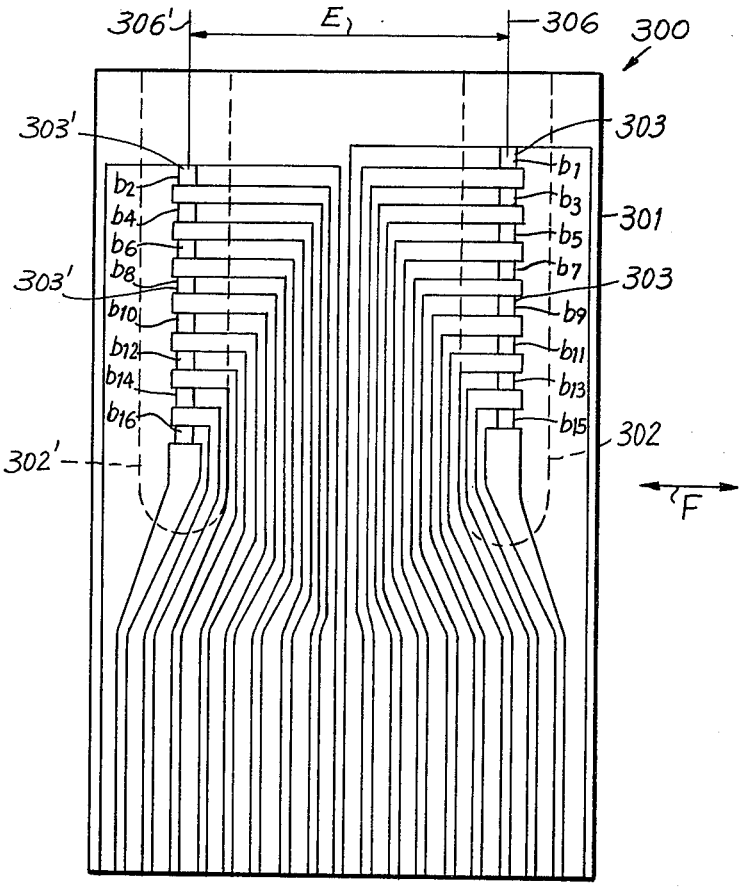
FIG. 13 is a plan view of a thermal printing head having two sets of heating elements constructed in accordance with a further embodiment of the present invention.

Referring now to FIG. 13, another embodiment of the present invention will be described. A thermal printing head, generally indicated as 300, includes a substrate 301 having two glaze layers 302 and 302' indicated by broken lines disposed thereon. Seven heating elements 303 and 303' are disposed respectively on each glaze layer 302 and 302'. The heating elements 303 on glaze layer 302 are designated as $b_1$, $b_3$, . . . $b_{15}$. Heating elements 303' on glaze layer 302' are designated $b_2$, $b_4$, . . . $b_{16}$. Each vertical column of heating elements 303 and 303' define a longitudinal axis respectively designated as 306 and 306'. The heating elements are aligned on the respective longitudinal axes 306 and 306' which also serves as the longitudinal axis of the respective glaze layers 303 and 303'. Heating elements 303 including elements $a_1$ through $a_{15}$ are spaced from heating elements 303' including elements $a_2$ through $a_{16}$ by a distance indicated by E which is an integral multiple of a ½ dot pitch. It is desirable that the distance designated by E be an odd integral multiple of the ½ dot pitch in order to limit a peak current when the respective heating elements 303 and 303' are heated simultaneously. Heating elements 303 and 303' should preferably be arranged symmetrically with respect to a line across the direction of travel of the printing head designated by arrow F which allows the head to be mass-produced.

Eight heating elements each are disposed on the two glaze layers 302 and 302' and thus a total of 16 heating elements serve to define one vertical line of a character to be printed. A Chinese character which cannot be printed with a 5×7 dot matrix can be printed with a 16×16 dot matrix as provided in FIG. 13.

Figure 14:
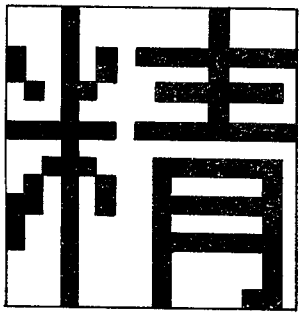
FIG. 14 is an illustration of a Chinese character printed by the thermal printing head depicted in FIG. 13.

FIG. 14 illustrates a Chinese character printed by the printing head depicted in FIG. 13. Additionally, alphabetical characters, numerals and the like can be printed with a quality close to that of actual type faces utilizing the printing head depicted in FIG. 13.

The present invention, as described in detail herein, is readily adaptable for use in a thermal printer in which the current that flows through the heating elements is limited and the thermosensitive paper can be brought into closer contact with the heating elements for an improved degree of printing quality. The configuration of the glaze layer and the staggered spacing of the heating elements with respect to the central axis of the glaze layer allow characters to be printed by half dot spacing with a substantial increase in printing quality. The heating elements require a sufficiently low power such that the printing head of the present invention in combination with a thermal printer can be incorporated in a pocket electronic calculator which can be powered by a manganese battery.

It will thus be seen that the object set forth above, among those made apparent from the preceeding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also be understood that the following claims are intended to cover all of the generic and specific features of the invention herein described and all statements of the scope of the invention which, as a matter of language, might be said to fall therebetween.

What is claimed is:

1. A printing head for a thermal printer, said thermal printer including means for laterally translating said printing head across a thermosensitive recording medium for thermally printing a row of characters across said thermosensitive medium comprising a substrate, a glazer layer formed on a portion of said substrate and extending essentially longitudinal to the lateral direction of translation of said printing head, heating means for forming dots on said thermosensitive medium to define said characters including a first and second group of heating elements disposed along said glaze layer, said glaze layer acting as a thermal resistance layer and having a substantially smooth surface so that said first and second groups of heating elements can be brought into close contact with said thermosensitive medium, said glaze layer being arched in the lateral direction and defining a crest, said glaze layer crest defining a first longitudinal axis along said glaze layer, said first and second groups of heating elements being staggered with respect to each other along said first longitudinal axis, said first and second groups of heating elements respectively defining second and third longitudinal axes, said second longitudinal axis being positioned on one side of said first longitudinal axis, said third longitudinal axis being positioned on the other side of said first longitudinal axis, and electrode means for selectively activating said heating elements in said first and second groups.

2. The printing head as claimed in claim 1, wherein said heating elements in said first group are staggered in overlapping relation with respect to said heating elements in said second group along the longitudinal direction of said glaze layer.

3. The printing head as claimed in claim 1, wherein said glaze layer includes upper and lower ends and two sides, the lower end of said glaze layer being inclined toward said substrate.

4. The printing head as claimed in claim 3, wherein the lower end of said glaze layer forms an obtuse angle with respect to said sides of said glaze layer.

5. The printing head as claimed in claim 1, wherein said glaze layer includes upper and lower ends and two sides, said lower end forming an obtuse angle with respect to said two sides of said glaze layer.

6. The printing head as claimed in claim 1, wherein said two groups of heating elements are spaced from each other in the lateral direction of translation of said printing head by a distance substantially equal to an integral multiple of a half dot pitch of the dots which form said characters.

7. The printing head as claimed in claim 6, wherein said first and second groups of heating elements together include first through seventh heating elements, said first, third, fourth and sixth heating elements being in said first group, said second, fifth and seventh heating elements being in said second group.

8. The printing head as claimed in claim 1, wherein said glaze layer includes upper and lower ends and two sides, the lower end of said glaze layer forming an obtuse angle with respect to said sides of said glaze layer.

9. The printing head as claimed in claim 8, wherein said lower end is arcuately shaped and inclined towards said substrate.

10. The printing head as claimed in claim 1, further comprising an acid-proof layer and a wear-resistant layer formed on said substrate and overlapping said glaze layer.

11. A printing head for a thermal printer, said thermal printer including means for laterally translating said printing head across a thermosensitive recording medium for thermally printing a row of characters across said thermosensitive medium comprising a substrate, an elongated glaze layer formed on a portion of said substrate and extending longitudinally therealong, a plurality of heating elements disposed on said glaze layer, said glaze layer including upper and lower ends and two sides, said lower end forming an obtuse angle with respect to said two sides so that said heating elements can be brought into close contact with said thermosensitive medium, and electrode means disposed on said substrate and extending proximate said heating elements for selectively activating said heating elements to form dots on said thermosensitive medium which define said characters.

12. The printing head as claimed in claim 5 or 11, wherein said lower end of said glaze layer is inclined towards said substrate.

13. The printing head as claimed in claim 12, wherein said two groups of heating elements together include first through seventh heating elements, said first, third, fourth and sixth heating elements being in said first group, said second, fifth and seventh heating elements being in said second group.

14. The printing head as claimed in claim 13, wherein the distance between said second and third longitudinal axes respectively and said first longitudinal axis is equal to an integral multiple of a quarter of the distance in the lateral direction between said dots which form said characters.

15. The printing head as claimed in claim 14, wherein said heating elements are made of $Ta_2N$.

16. The printing head as claimed in claim 15, wherein said substrate is formed from alumina.

17. The printing head as claimed in claim 11, further comprising an acid-proof layer and a wear-resistant layer formed on said substrate and overlapping said glaze layer.

18. A printing head for a thermal printer, said thermal printer including means for laterally translating said printing head across a thermosensitive recording medium for thermally printing a row of characters across said thermosensitive medium comprising a substrate, first and second glaze layers formed on a portion of said substrate, said first and second glaze layers being spaced from one another in the lateral direction, a plurality of heating elements disposed on each said first and second glaze layers, and electrode means disposed on said substrate and extending proximate said heating elements on said first and second glaze layers for selectively activating said heating elements to form dots on said thermosensitive medium which define said characters.

19. The printing head as claimed in claim 18, wherein said first glaze layer is spaced from said second glaze layer by a distance equal to an integral multiple of a one-half dot pitch.

20. The printing head as claimed in claim 18, wherein said first and second glaze layers include upper and lower ends and two sides, the lower end of each said glaze layer being inclined toward said substrate.

21. The printing head as claimed in claim 20, wherein the lower end of each said glaze layer forms an obtuse angle with respect to said sides of each said glaze layer, respectively.

22. The printing head as claimed in claim 18, further comprising an acid-proof layer and a wear-resistant layer formed on said substrate and overlapping said glaze layers.

* * * * *